US005829966A

United States Patent [19]

Stoner

[11] Patent Number: 5,829,966

[45] Date of Patent: Nov. 3, 1998

[54] HEATING FUEL CARTRIDGE AND METHOD

[75] Inventor: Daniel P. Stoner, Yorba Linda, Calif.

[73] Assignee: STO Corporation, Riverside, Calif.

[21] Appl. No.: 44,730

[22] Filed: Mar. 19, 1998

[51] Int. Cl.[6] ..... F23D 3/24

[52] U.S. Cl. ..... 431/320; 431/321

[58] Field of Search ..... 431/320, 321

[56] References Cited

U.S. PATENT DOCUMENTS

| | | | |
|---|---|---|---|
| 2,441,242 | 5/1948 | Harkins | 67/55 |
| 3,171,398 | 3/1965 | Lawson | 126/4 |
| 4,013,397 | 3/1977 | Neugart | 431/291 |
| 4,624,633 | 11/1986 | Bandel | 432/320 |
| 4,725,225 | 2/1988 | Gravitt | 431/320 |
| 4,850,858 | 7/1989 | Blankenship | 431/320 |
| 4,896,653 | 1/1990 | Eke et al. | 126/45 |
| 4,911,139 | 3/1990 | Yost | 126/45 |
| 5,307,799 | 5/1994 | Scarnato et al. | 126/45 |
| 5,405,262 | 4/1995 | Appel | 431/320 |
| 5,525,055 | 6/1996 | Menter et al. | 431/320 |
| 5,529,485 | 6/1996 | D'Ambro et al. | 431/321 |

*Primary Examiner*—Carroll B. Dority

*Attorney, Agent, or Firm*—John S. Christopher

[57] ABSTRACT

A heating fuel cartridge for use in heating food placed in a chafing dish mounted in a metal frame enclosure typically employed in a buffet line is disclosed. A preferred embodiment of the invention includes a container comprised of a base and a continuous cylindrical sidewall for containing a liquid fuel. A one-piece, disk-shaped top surface is mounted upon the sidewall and includes an upward extending annular ridge integrally formed in the top surface for defining an inner circular portion and an outer circular portion. The top surface is fabricated by a single stamping motion. Thus, the disk-shaped top surface including the annular ridge comprises a one-piece unitary construction. A wick used to burn the liquid fuel projects upward from the inner circular portion. A removable cap which is press fitted into the upward extending annular ridge serves to snuff the flame and seal the inner circular portion of the one-piece top surface. In a preferred embodiment, the heating fuel cartridge is fashioned from tin plate having an inner anti-rust coating. In addition to a small serrated penetration to enable a wick to project through, the inner circular portion also includes a breather hole. The removable cap which seals the wick cooperates with the annular ridge in a press fit manner. The cap and/or the annular ridge may include a soft coating to assist in the insertion or removable thereof.

19 Claims, 2 Drawing Sheets

HEATING FUEL CARTRIDGE AND METHOD

BACKGROUND OF THE INVENTION

1. Field of the Invention

The present invention relates to a self-contained, disposable, liquid fuel heat generating device. More specifically, the present invention relates to methods and apparatus for a heating fuel cartridge for use with a chafing dish typically found in a food serving line and also for use in the camping environment and as a source of emergency heating.

2. Description of the Related Art

The relevant art is directed to heat generating containers often referred to as liquid fuel cartridges. The liquid fuel cartridges are typically employed to warm food in a buffet line normally located in a restaurant or a hotel dining room. In this environment, the food is typically placed in a warming or chafing dish or tray. The food warming dish is then positioned at the top of a metal frame enclosure. The metal frame enclosure includes a bottom pan designed to hold a volume of water.

The bottom of the metal frame enclosure is arranged to accommodate a plurality of the liquid fuel cartridges. When ignited, the cartridges serve to heat the water in the bottom pan of the metal frame enclosure. The heated water produces steam to keep the food in the chafing dish warm during the food serving period. Typically, the cartridges will burn for a four-to-six hour period. Consequently, the fuel cartridges can often be utilized a second time. To accommodate a second use of the cartridges, the flame is snuffed out and the wick area is covered to prevent leakage of the liquid fuel during the non-use time period.

In early prior art devices, the fuel cartridge contained and burned a gelled fuel. The container or can portion of the cartridge, which was filled with the gelled fuel, was intended to be used to heat the water in the bottom pan beneath the food chafing dish. In some cases, the gelled fuel within the fuel cartridge burned to hot causing the food to overheat. This situation occurred because the gelled fuel comprised gelled alcohol. Typically, gelled alcohol burns at a high temperature and, in many cases, burns too hot for a food warming application. Thus, the use of gelled alcohol as a fuel can prove to be excessive and unsatisfactory in a food warming application.

In other prior art devices, the fuel cartridge utilizes liquid fuel to generate a flame and consequently heat. The liquid fuel variety of fuel cartridge utilizes diethylene glycol and provides better service by burning for a longer period of time. In one liquid fuel device, the cartridge is comprised of a steel can formed in the shape of a cylinder where the top of the can is open. The top of the can is subsequently covered by a flat metal disk that is sealed to the circular edge of the steel can. The flat metal disk includes a large center circular penetration which accommodates a metallic "press-in" member. The "press-in" member includes a metal vertical projection that is employed to accommodate a wick used to burn the fuel and generate the flame. The wick and metal vertical projection are covered by a rubber cap to prevent fuel leakage when the cartridge is not in use. Because the cap is comprised of rubber, it does not snuff the flame safely after use of the fuel cartridge. Consequently, the flame must be blown out which creates smoke in the food serving area. Since the metal vertical projection is hot after use of the fuel cartridge, the rubber cap will melt when in contact therewith. Finally, the rubber cap is easily lost which frustrates the effort to prevent fuel leakage from the container during periods of non-use.

In a second prior art liquid fuel device, the cartridge is comprised of a similar steel container or can formed in the shape of a cylinder. The container or can is open at the top. The top of the can is covered by a metal disk which may be corrugated to increase the strength of construction. The top metal disk is sealed to the open top of the container or can. Integrally attached to the top metal disk is an orthogonally positioned, hollow threaded vertical projection. The top end of the hollow threaded vertical projection is also open. A flat metal seal is pressed into the open end of the threaded vertical projection. A penetration is formed in the flat metal seal to accommodate a wick. A screw cap having threads matching those of the threaded vertical projection cooperates therewith to snuff out the flame and seal the wick. Although very functional, the top metal disk and the integral hollow threaded vertical projection require the use of expensive soft steel to form the threads and a multiple step process to fabricate.

Thus, there is a need in the art for a liquid heating fuel cartridge that can be comprised of an inexpensive material, does not require an upward extending projection or threads formed thereon or a cap having matching threads, does not have a large center circular penetration in the top metal disk requiring a metallic "press-in" member, or a rubberized cap that does not snuff the flame in a satisfactory manner, but does include a construction which can be fabricated in a few stamping motions including a cap that is easily installed to properly snuff the flame and prevent leakage and simple to remove, exhibits a low profile design, and is economical to manufacture.

SUMMARY OF THE INVENTION

Briefly, and in general terms, the present invention provides a new and improved liquid heating fuel cartridge for use in heating food placed in a chafing dish mounted in a metal frame enclosure typically employed in a buffet line. The novel and non-obvious heating fuel cartridge exhibits a construction which can be fabricated in a few stamping motions. The cartridge includes a cap that is easily installed to properly snuff the flame and prevent leakage and is simple to remove. The invention is economical to manufacture and also exhibits a low profile design that will fit beneath all standard chafing dishes and metal frame enclosures.

The present invention is generally directed to a liquid heating fuel cartridge for use with a standard chafing dish and is typically employed in a buffet line located, for example, in a restaurant, hotel dining room, or convention or reception hall. In its most fundamental embodiment, the heating fuel cartridge comprises a construction incorporating a plurality of features including a container comprised of a base and a continuous cylindrical sidewall for containing a liquid fuel. A one-piece, disk-shaped top surface is mounted upon the sidewall. The one-piece top surface includes an upward extending annular ridge integrally formed in the top surface for defining an inner circular portion and an outer circular portion in the top surface. The top surface is fabricated by a single stamping motion. A wick used to burn the liquid fuel projects upward from the inner circular portion. A cap which is press fitted into the upward extending annular ridge serves to snuff the flame and seal the inner circular portion of the one-piece top surface.

In a preferred embodiment, the heating fuel cartridge includes a container and cap fashioned from tin plate having an inner anti-rust coating which is economical compared to the soft steel requirement of prior art fuel devices. Mounted directly on the upper edge of the container is a disk-shaped top surface which is fabricated in a single stamping motion. The top surface includes an annular ridge formed therein to provide an outer circular portion and an inner circular portion. Thus, the disk-shaped top surface including the annular ridge comprises a one-piece unitary construction. In addition to a small serrated penetration to enable a wick to project through, the inner circular portion also includes a breather hole. A removable cap which seals the wick cooperates with the annular ridge in a press fit manner. The cap and/or the annular ridge may include a soft coating to assist in the insertion or removable thereof. The container including the one-piece top surface serves as a reservoir for the liquid fuel.

These and other objects and advantages of the present invention will become apparent from the following more detailed description, taken in conjunction with the accompanying drawings which illustrate the invention, by way of example.

DESCRIPTION OF THE INVENTION

Figure 1:
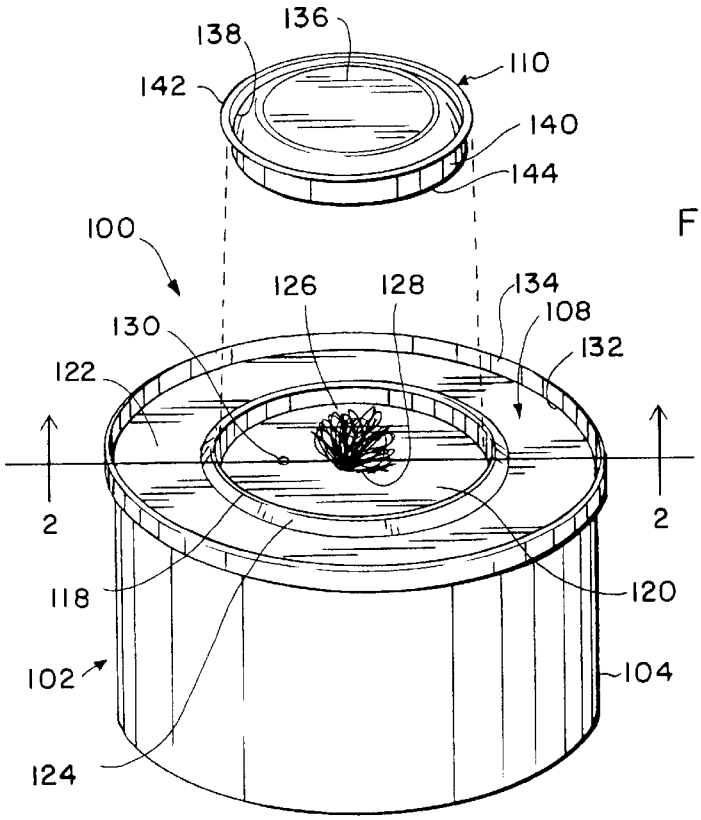
FIG. 1 is a perspective view of a heating fuel cartridge of the present invention showing a cylindrical container covered by a one-piece disk-shaped top surface having an annular ridge formed thereon and a removable cap shown separated from the top surface.
Figure 2:
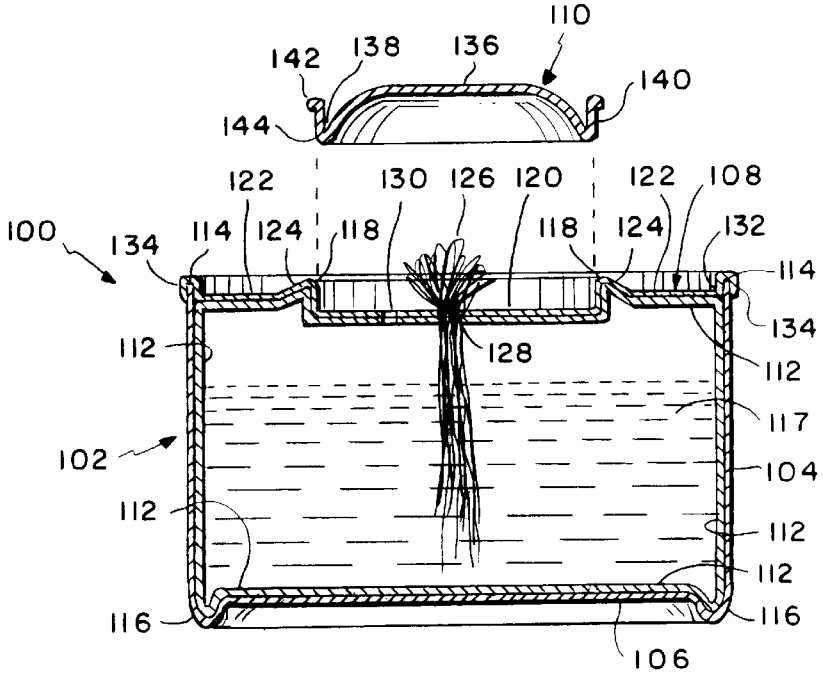
FIG. 2 is a cross-sectional view of the heating fuel cartridge taken along line 2—2 of FIG. 1 showing the cylindrical container, the one-piece disk-shaped top surface including the annular ridge, a wick immersed in a liquid fuel, and the removable cap separated from the one-piece top surface.

The present invention is a heating fuel cartridge 100 as shown in FIGS. 1–2 for use with a chafing dish mounted in a metal frame enclosure (not shown). The heating fuel cartridge 100 of the present invention serves to heat or warm food placed in the chafing dish by providing heat to the bottom surface thereof. The heating fuel cartridge 100 is typically employed in a buffet line in a restaurant, hotel dining room, or convention or reception hall where heated food is provided to a large gathering of people.

A preferred embodiment of the heating fuel cartridge 100 is shown in FIGS. 1–4 and includes a container 102 having a sidewall 104 and a base 106, a one-piece, disk-shaped top surface 108, and a removable cap 110 best shown in FIGS. 1 and 2. The container 102 is shaped as a right circular cylinder as is clearly shown in FIGS. 1 and 2 and is comprised of a steel-tin alloy normally referred to a tin-plate. This alloy combination of materials is substantially more economical than the soft steel required in prior art containers. The more expensive soft steel is not required in the heating fuel cartridge 100 of the present invention because the costly vertical projections, with or without the formation of threads thereon, and a cap having corresponding threads have been eliminated.

The inside surface of the sidewall 104 and the base 106 of the steel-tin alloy container 102 and the underside of the one-piece disk-shaped top surface 108 can include an inner coating 112 to inhibit the formation of rust on the inside surface of the cartridge 100 as is shown in FIG. 2. The inner coating 112 is necessary since the steel-tin alloy, when exposed to moisture, will rust. The container 102 includes an annular upper edge 114 located at the top of the sidewall 104 upon which the one-piece disk-shaped top surface 108 is mounted. The annular upper edge 114 of the container 102 is best shown in FIG. 2. The container 102 also includes an annular rounded edge 116 located at the bottom of the sidewall 104 which serves to support the heating fuel cartridge 100 upon a support surface (not shown). The annular rounded edge 116 of the container 102 is also best shown in FIG. 2.

Figure 4:
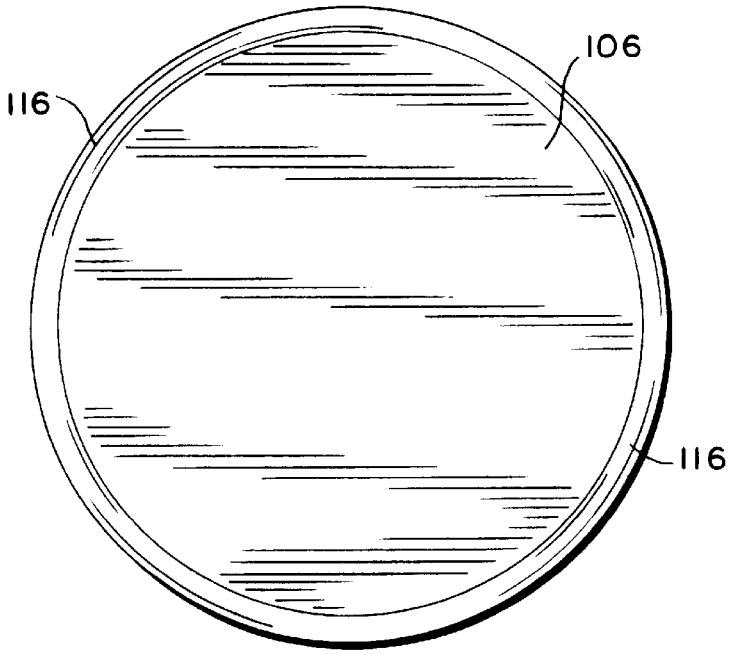
FIG. 4 is a bottom plan view of the heating fuel cartridge of FIG. 1 showing a rounded edge forming the base of the cylindrical container.

The base 106 of the container 102 is a plane-shaped member that encloses the bottom of the container 102 within the circumference of the annular rounded edge 116 at the bottom of the cylindrical sidewall 104 as shown in FIGS. 2 and 4. The base 106 is continuous with the sidewall 104 so that the entire container 102 is of unitary construction. Prior to mounting the one-piece, disk-shaped top surface 108 in position, the container 102 is filled to the appropriate level with a liquid fuel 117 such as, for example, diethylene glycol or an equivalent. The volume of liquid fuel 117 deposited into the container 102 is sufficient to enable the burning cycle of the heating fuel cartridge 100 to last from four-to-six hours.

The one-piece, disk-shaped top surface 108 is a single circular piece of steel-tin alloy formed in a single stamping motion during the process of fabricating the heating fuel cartridge 100. There are at least two methods to fabricate the one-piece, disk-shaped top surface 108 for use in the present invention. In one procedure, the top surface 108 can be fabricated in a single step by mounting rolls or coils of tin plate stock (not shown) onto a suitable fabrication machine (not shown) known in the art in a manner that the stock is fed to the fabrication machine for stamping the top surface 108 in proper form. In this description, stamping refers to a single metal shaping motion. In an alternative procedure, the one-piece, disk-shaped top surface 108 can be fabricated in a single step by stacking strips of tin plate (not shown) onto a suitable fabrication machine (not shown) known in the art so that the stock is fed to the machine. In this procedure, the strips of tin plate have a width suitable for stamping into the shape of the one-piece, disk-shaped top surface 108.

Figure 3:
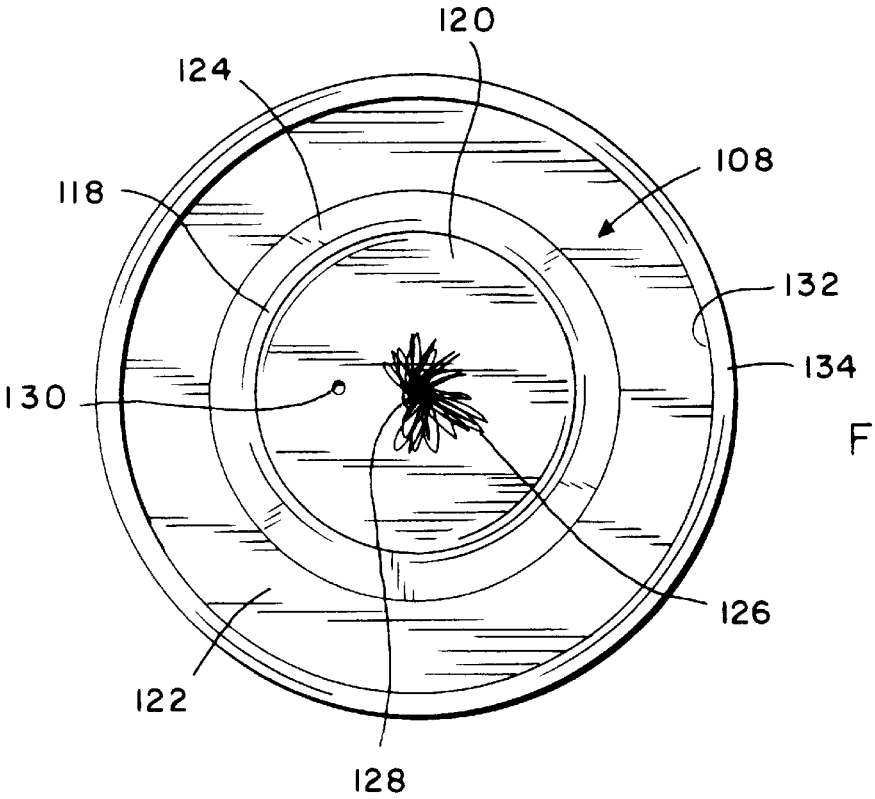
FIG. 3 is a top plan view of the heating fuel cartridge of FIG. 1 showing the one-piece disk-shaped top surface including the annular ridge, an outer circular portion, and an inner circular portion which includes a breather hole and the wick.

During the fabrication process, the tin plate stock is stamped to produce the one-piece, disk-shaped top surface 108 as shown in FIGS. 2 and 3. During the stamping process, an upward extending annular ridge 118 is integrally formed in a central region of the top surface 108 as is shown in FIGS. 1–3. The annular ridge 118 separates the top surface 108 into two regions which define an inner circular portion 120 and an outer circular portion 122. Both the inner circular portion 120 and the outer circular portion 122 exhibit a flat planar surface comprised of steel-tin alloy. However, it is within the scope of the present invention to provide corrugations in the planar surface of, for example, the outer circular portion 122 to increase the strength of the one-piece, disk-shaped top surface 108.

The annular ridge 118 includes an inclined surface 124 that distinctly separates the outer circular portion 122 from the inner circular portion 120. The inclined surface 124 is positioned adjacent to the outer circular portion 122. The inclined surface 124 abruptly drops in an orthogonal manner to the inner circular portion 120 which is at a level below that of the outer circular portion 122 as shown in FIG. 2. Thus, the inner circular portion 120 is recessed at a planar level below the planar level of the outer circular portion 122. The inner circular portion 120 is recessed to accommodate the insertion of the removable cap 110 within the upward extending annular ridge 118 as described hereinbelow. Since the outer circular portion 122, the inner circular portion 120 and the annular ridge 118 are of one-piece unitary construction, the metallic member normally "pressed-into" a large circular penetration formed in the top surface of containers of the prior art has now been eliminated.

A wick 126 is shown projecting from the inner circular portion 120 in FIGS. 1–3. The wick 126 passes through a small penetration 128 into the liquid fuel 117 best shown in FIG. 2. An example of a suitable material from which the wick 126 would typically be fashioned from is fiberglass. The small penetration 128 formed in the center of the inner circular portion 120 is serrated to hold the fiberglass wick 126 in position. The fiberglass wick 126 serves as a conduit for the passage of liquid fuel 117 to the top if the wick 126 via capillary action which is well understood in the art. Although the fiberglass material serves as a conduit for transmitting the liquid fuel 117 from the container 102 to the top of the wick 126, it resists burning itself. This ensures that the wick 126 will last the life of the heating fuel cartridge 100. The inner circular portion 120 also includes a small breather hole 130 shown in FIG. 2 for the passage of air to prevent drawing a vacuum inside the heating fuel cartridge 100 which would interfere with normal operation.

The construction of the one-piece, disk-shaped top surface 108 having been described in detail, it is subsequently attached to the annular upper edge 114 of the sidewall 104 of container 102. The attachment of the top surface 108 to the upper edge 114 of the sidewall 104 is typically accomplished by a procedure known as "seaming" which is well known in the art. After the container 102 has been filled with the liquid fuel 117, an outer edge 132 of the one-piece, disk-shaped top surface 108 is rolled with the annular upper edge 114 of the sidewall 104 to form a double seam 134. This procedure is accomplished by an appropriate machine (not shown) which is well known in the art. The removable cap 110 of the heating fuel cartridge 100 is clearly illustrated in FIGS. 1 and 2. The removable cap 110 serves to seal the cartridge 100 during shipping to prevent the liquid fuel 117 from escaping through the wick 126 and/or the breather hole 130. Further, the cap 110 is also used to safely snuff the flame in the wick 126 when the heat is no longer required and to recap the cartridge 100 after use. The removable cap 110 is also fashioned from steel-tin alloy and is fabricated in a stamping procedure. The cap 110 includes a center positioned, circular raised area 136 which slopes off into a continuous trough 138. The trough 138 raises to form a vertical wall 140 which includes a curled edge 142 as is shown in FIGS. 1 and 2.

The removable cap 110 is constructed to fit over the inner circular portion 120 of the top surface 108. The bottom 144 of the cap 110 is fabricated to press fit inside the upward extending annual ridge 118 of the top surface 108. When installed, the curled edge 142 of the cap 110 seats on top of the annular ridge 118. The curled edge 142 forms a flange-like lip which facilitates removal of the cap 110 with, for example, a screwdriver, the edge of a spoon or the like. Further, the bottom 144 of the cap 110 or the inside of the annular ridge 118 may include a soft coating of, for example, polyethylene of a suitable thickness to assist in the sealing procedure.

During fabrication, the container 102 is formed in the preferred shape of a right circular cylinder comprised of steel-tin alloy in a manner well known in the art. The container 102 is then filled to the proper level with the liquid fuel 117. Thereafter, the one-piece, disk-shaped top surface 108 is fabricated in a single step by mounting rolls or coils of tin plate stock (not shown) onto a suitable known fabrication machine (not shown) so that the stock is fed to the fabrication machine for stamping the top surface 108 in proper form. In the alternative, strips of tin plate of a suitable width (not shown) are stacked onto a known fabrication machine (not shown) so that the stock is fed to the machine.

The one-piece, disk-shaped top surface 108 is then fabricated in the single stamping motion which provides the upward extending annular ridge 118, the serrated penetration 128 and the breather hole 130. Then, the wick 126 is passed through and anchored to the small serrated penetration 128. The removable cap 110 having been fabricated in a stamping procedure is press fitted into the upward extending annular ridge 118. The one-piece, disk-shaped top surface 108 is now completely formed. Finally, the top surface 108 is fastened to the container 102 by utilizing a seaming machine (not shown) to roll the upper edge 114 of the sidewall 104 with the outer edge 132 of the top surface 108 in the double seal 134. The wick 126 is now submersed into the liquid fuel 117 and the liquid fuel cartridge is ready for use. It is noted that each of the forgoing steps is completed automatically by a suitable programmed machine as is known in the art.

The present invention provides novel advantages over other fuel cartridges and methods known in the prior art. The heating fuel cartridge 100 of the present invention exhibits a low profile design so that the cartridge 100 fits properly beneath all standard chafing dishes mounted within a frame. Further, the present invention uses more cost effective materials and thus can be fabricated at a lower cost than prior art fuel containers, does not require the formation of costly vertical projections or threads or a threaded cap, includes a metal cap 110 that serves to seal the cartridge 100 and safely snuff the flame after use, and is more economical since the top surface 108 can be fabricated in a single stamping motion and the cartridge 100 can be completely fabricated in just a few stamping motions instead of the multiple progressive steps and dies required in some prior art containers. It is noted that the heating fuel cartridge 100 is useful as a source of emergency heating, if required. It is further noted that the heating fuel cartridge 100 can also be employed for cooking and other uses in the outdoor camping environment.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A heating fuel cartridge comprising:

a container comprised of a base and a continuous cylindrical sidewall for containing a liquid fuel;

a one-piece, disk-shaped top surface mounted upon said sidewall, a central region of said one-piece top surface being pressed inwardly to form an annular ridge located between an inner circular top surface portion and an outer annular top surface portion, said top surface being formed by a single stamping motion;

a wick projecting upward from and supported in an opening in said inner circular portion; and a cap press fitted within said annular ridge for sealing said inner circular portion.

2. The heating fuel cartridge of claim 1 wherein said cartridge is comprised of a steel-tin alloy.

3. The heating fuel cartridge of claim 1 wherein said cartridge is formed in the shape of a right circular cylinder.

4. The heating fuel cartridge of claim 1 wherein said liquid fuel is diethylene glycol.

5. The heating fuel cartridge of claim 1 wherein said wick is comprised of fiberglass.

6. The heating fuel cartridge of claim 1 wherein said wick extends into said liquid fuel within said container.

7. The heating fuel cartridge of claim 1 wherein said wicks opening includes a serrated edge to hold said wick in position.

8. The heating fuel cartridge of claim 1 wherein said top surface further includes a breather hole formed in said inner top surface circular portion.

9. The heating fuel cartridge of claim 1 wherein said one-piece, disk-shaped top surface is attached to said sidewall with a double seam.

10. The heating fuel cartridge of claim 1 wherein the level of said inner top surface circular portion is recessed below the level of said outer annular top surface portion.

11. The heating fuel cartridge of claim 1 wherein said cap includes a rolled edge to assist in removal from said annular ridge.

12. A heating fuel cartridge for use in a food serving line comprising:

a container comprised of a circular base and a continuous cylindrical sidewall for containing a liquid fuel;

a one-piece, disk-shaped top surface mounted upon said cylindrical sidewall, a central region of said one-piece top surface being pressed inwardly to form an annular ridge located between an inner circular top surface portion and an outer annular top surface portion, said top surface being formed by a single stamping motion;

a wick projecting upward through and supported in an opening in said inner circular top surface portion, said opening formed by a serrated edge; and a removable cap having a rolled edge and press fitted within said annular ridge for sealing said inner circular top surface portion.

13. A method for constructing a heating fuel cartridge for use in a food serving line, said method comprising the steps of:

providing a container comprised of a base and a continuous cylindrical sidewall for containing a liquid fuel;

forming a one-piece, disk-shaped top surface with a single stamping motion, pressing a central portion of said top surface inwardly to form an annular ridge for defining an inner circular top surface portion and an outer portion;

projecting a wick upward through a serrated penetration in said inner circular portion;

fitting a cap within said upward extending annular ridge for sealing said inner circular portion; and anchoring said one-piece, disk-shaped top surface upon said sidewall with a double seal.

14. The method of claim 13 further including the step of building said heating fuel cartridge from a steel-tin alloy.

15. The method of claim 13 further including the step of forming a breather hole in said inner circular top surface portion.

16. The method of claim 13 further including the step of forming a rolled edge on said cap to assist in removal from said annular ridge.

17. The method of claim 13 further including the step of forming said cartridge in the shape of a right circular cylinder.

18. The method of claim 13 further including the step of recessing said inner circular top surface portion at a level below the level of said outer annular top surface portion.

19. The method of claim 13 further including the step of fabricating said wick from fiberglass.

* * * * *

UNITED STATES PATENT AND TRADEMARK OFFICE

CERTIFICATE OF CORRECTION

PATENT NO. : 5,829,966

DATED : Nov. 3, 1998

INVENTOR(S) : Daniel P. Stoner, Yorba Linda, Calif.

It is certified that error appears in the above-indentified patent and that said Letters Patent is hereby corrected as shown below:

Claim 7, line 2 (Col. 7, line 16), change "wicks" to -- wick --.
Claim 13, line 7 (Col. 8, line 13), change "stamping motion, pressing" to -- stamping motion; pressing --.
Claim 13, line 9 (Col. 8, line 15), after "outer" insert -- annular top surface --.
Claim 13, line 12 (Col. 8, line 18), after "circular" insert -- top surface --.
Claim 13, line 13 (Col. 8, line 19), delete "upward extending".

Signed and Sealed this

Ninth Day of March, 1999

*Attest:*

Q. TODD DICKINSON

*Attesting Officer*

*Acting Commissioner of Patents and Trademarks*